US006334637B1

(12) United States Patent
Chioffi

(10) Patent No.: US 6,334,637 B1
(45) Date of Patent: Jan. 1, 2002

(54) LOCKING AND UNLOCKING DEVICE FOR THE DOOR OF A DOMESTIC ELECTRICAL APPLIANCE

(75) Inventor: Mario Chioffi, Frosinone (IT)

(73) Assignee: Bitron S.p.A., Turin (IT)

( * ) Notice: Subject to any disclaimer, the term of this patent is extended or adjusted under 35 U.S.C. 154(b) by 0 days.

(21) Appl. No.: 09/464,771

(22) Filed: Dec. 16, 1999

(30) Foreign Application Priority Data

Dec. 18, 1998 (IT) ..... TO98A1056

(51) Int. Cl.[7] ..... E05B 15/02

(52) U.S. Cl. ..... 292/341.16; 292/DIG. 65; 70/DIG. 10

(58) Field of Search ..... 292/125, 156, 292/255, 157, 144, 341.16, 28, DIG. 69, DIG. 65; 337/70, 71; 68/12.26; 70/DIG. 10

(56) References Cited

U.S. PATENT DOCUMENTS 3,638,457 A * 2/1972 Filipak ..... 68/12 R
4,082,078 A * 4/1978 Thuleen ..... 126/197
4,988,132 A * 1/1991 Rocchitelli ..... 292/144
6,036,241 A * 3/2000 Ostdiek ..... 292/229
6,082,787 A * 7/2000 Chioffi ..... 292/128

* cited by examiner

*Primary Examiner*—Gary Estremsky
(74) *Attorney, Agent, or Firm*—Sughrue Mion, PLLC

(57) ABSTRACT

The device comprises a support housing with an opening for the introduction of a hook connected to the door, a retaining member moving with respect to the housing between a rest position in which it enables the hook to be introduced into the opening and an operating position in which it is adapted to retain the hook introduced into this opening, a locking device including a locking member moving between a disengaged and an engaged position in which it is adapted to allow and respectively to prevent the retaining member from moving from the operating position to the rest position and a control device that can be electrically actuated and is adapted to control the position of the locking member. The control device comprises an electrically controlled actuator adapted, each time that it is actuated, to cause a toothed wheel having a predetermined cam or toothed control profile, which is coupled directly to a projection of the locking member, to move by a predetermined amount in such a way that in at least a first and respectively a second angular position of this wheel, this cam or toothed command profile retains and respectively releases the locking member preventing and respectively enabling it to move from the disengaged to the engaged position.

17 Claims, 6 Drawing Sheets

LOCKING AND UNLOCKING DEVICE FOR THE DOOR OF A DOMESTIC ELECTRICAL APPLIANCE

BACKGROUND OF THE INVENTION

The present invention relates to a locking and unlocking device for the door of a domestic electrical appliance, such as a washing machine or a washing and drying machine.

SUMMARY OF THE INVENTION

An object of the present invention is to provide a locking and unlocking device whose construction is simplified, that can be produced economically with a limited number of parts and components and that is nevertheless able to ensure highly reliable operation.

BRIEF DESCRIPTION OF THE DRAWINGS

Other advantages and characteristics of the invention will become clear from the following detailed description, provided purely by way of non-limiting example and given with reference to the appended drawings in which.

DETAILED DESCRIPTION OF THE INVENTION

Figure 1:
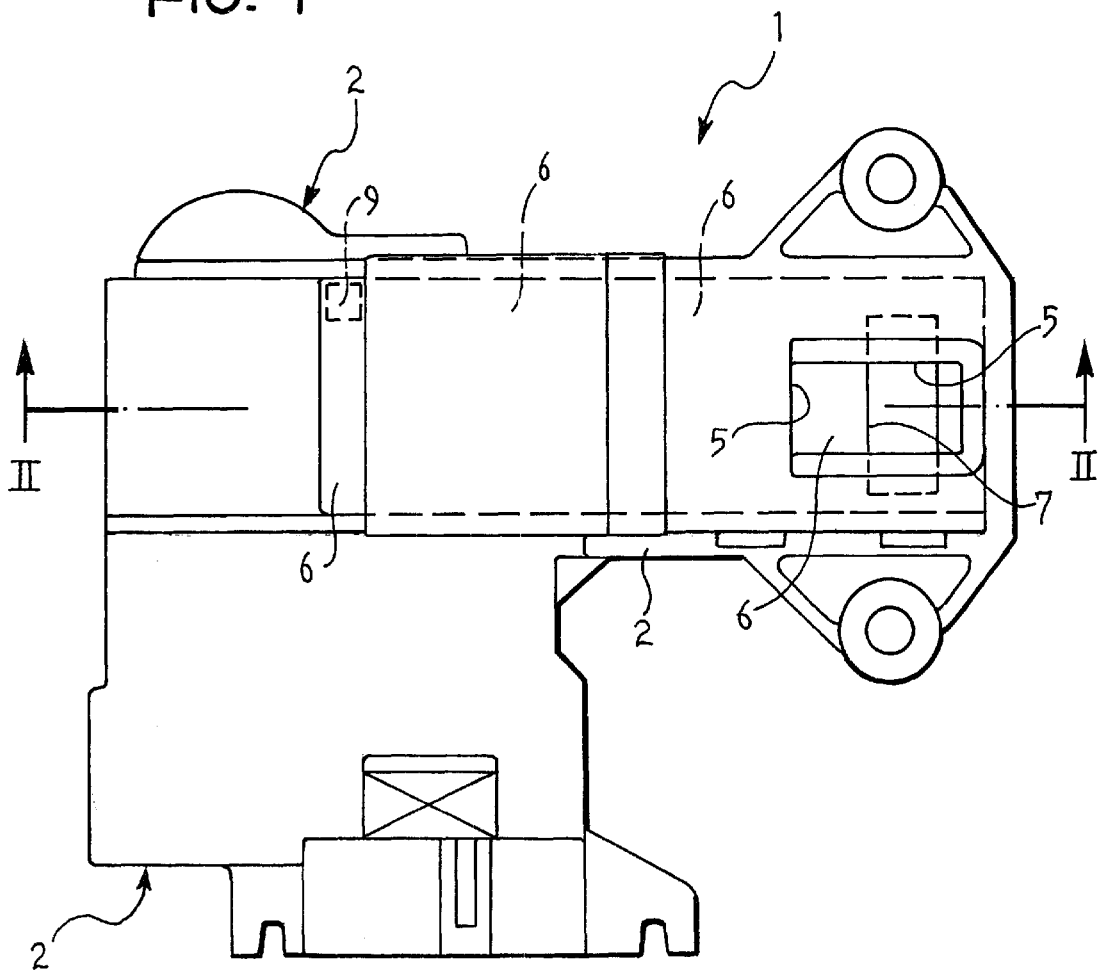
FIG. 1 is a front view of a locking and unlocking device of the invention.
Figure 2:
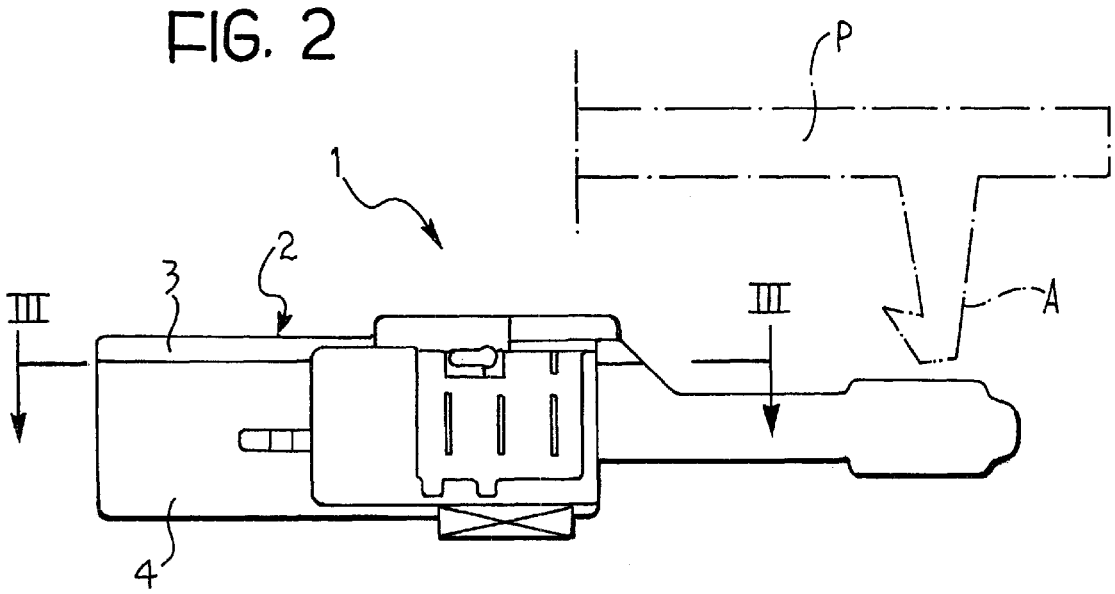
FIG. 2 is a side view of the device of FIG. 1.

In FIGS. 1 and 2, a locking and unlocking device of the invention is shown overall by 1.

Figure 4:
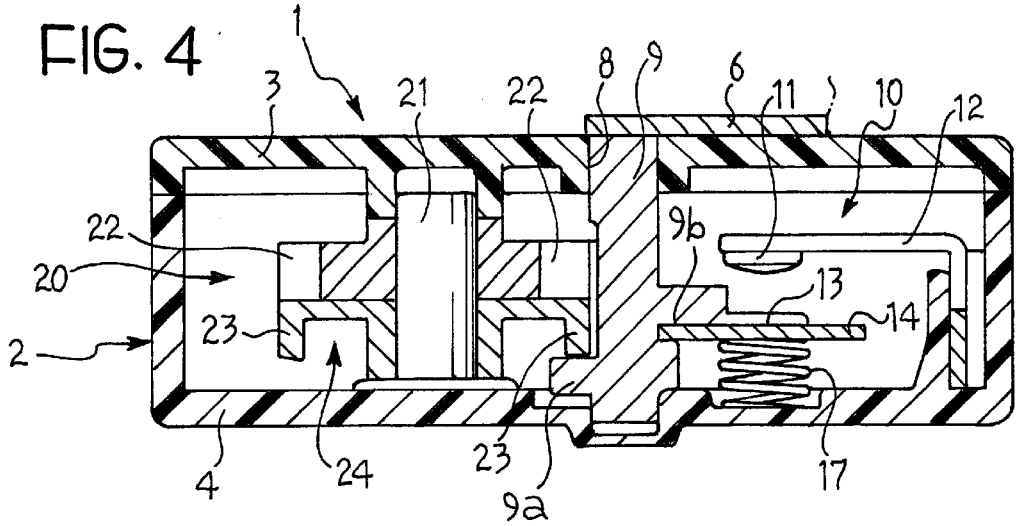
FIG. 4 is a sectional view, along the line IV—IV of FIG. 3.

This device comprises a support housing 2, of electrically insulating material, adapted to be secured to the body of a domestic electrical appliance, in the vicinity of a loading or access opening associated with a door P (FIG. 2) provided in a manner known per se with a hook member A. In the embodiment shown, the support housing 2 is formed by two half-shells 3 and 4 which are coupled together (FIGS. 2 and 4).

As shown in FIG. 1, the housing 2 of the device 1 has an opening 5 for the introduction of the hook member A borne by the door.

A retaining member or slide 6 provided with a window opening 7 adapted to be traversed by the hook member A is mounted to slide in the support housing 2 of the device 1.

When the door P is open (FIG. 2), the retaining member 6 is held (by an associated spring which is not shown) in a rest position (FIG. 1) in which its window 7 faces the opening 5 of the housing 2. In this position, the hook member A of the door may be introduced into the opening 5 and the window 7 when the door is closed and, vice versa, may be disengaged from this window and from this opening when the door is opened.

As shown in FIGS. 1 and 4, when the retaining member or slide 6 is in the rest position, it covers an opening 8 provided in the upper half-shell 3 of the support housing 2, into which a locking member 9 may be extended in translation.

Figure 6:
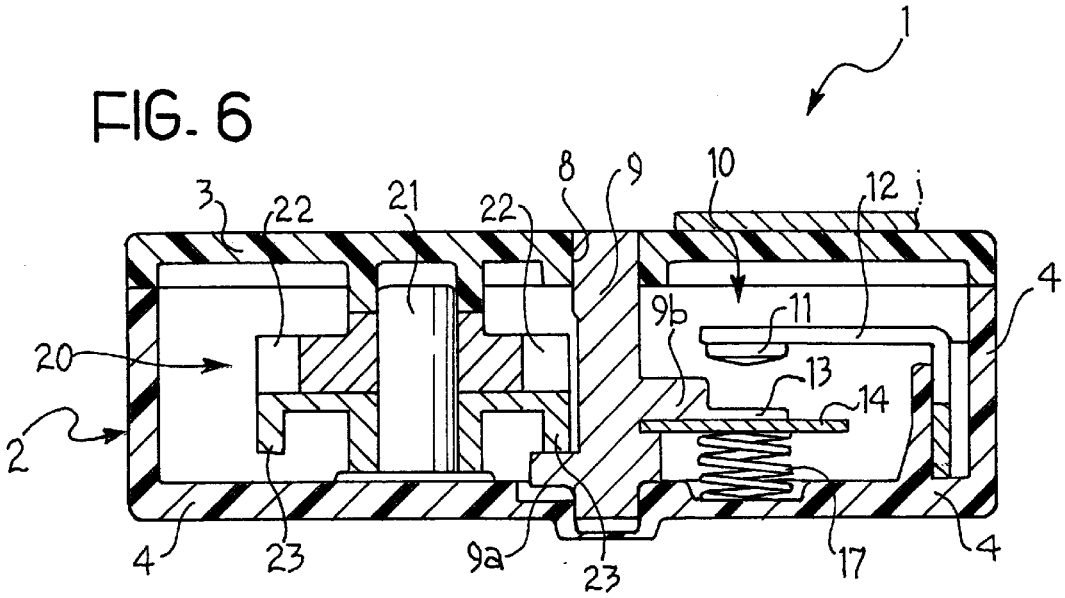
FIGS. 6 and 7 are views similar to that of FIG. 4, and show the device in other operating conditions.

In a manner known per se, the device is such that when the door is closed, the hook member A engages with the opening or window 7 of the retaining member or slide 6 and causes the latter to move in translation (to the right with respect to the FIGS. 1 or 4) in order to release the opening 8, as shown in FIG. 6.

Figure 3:
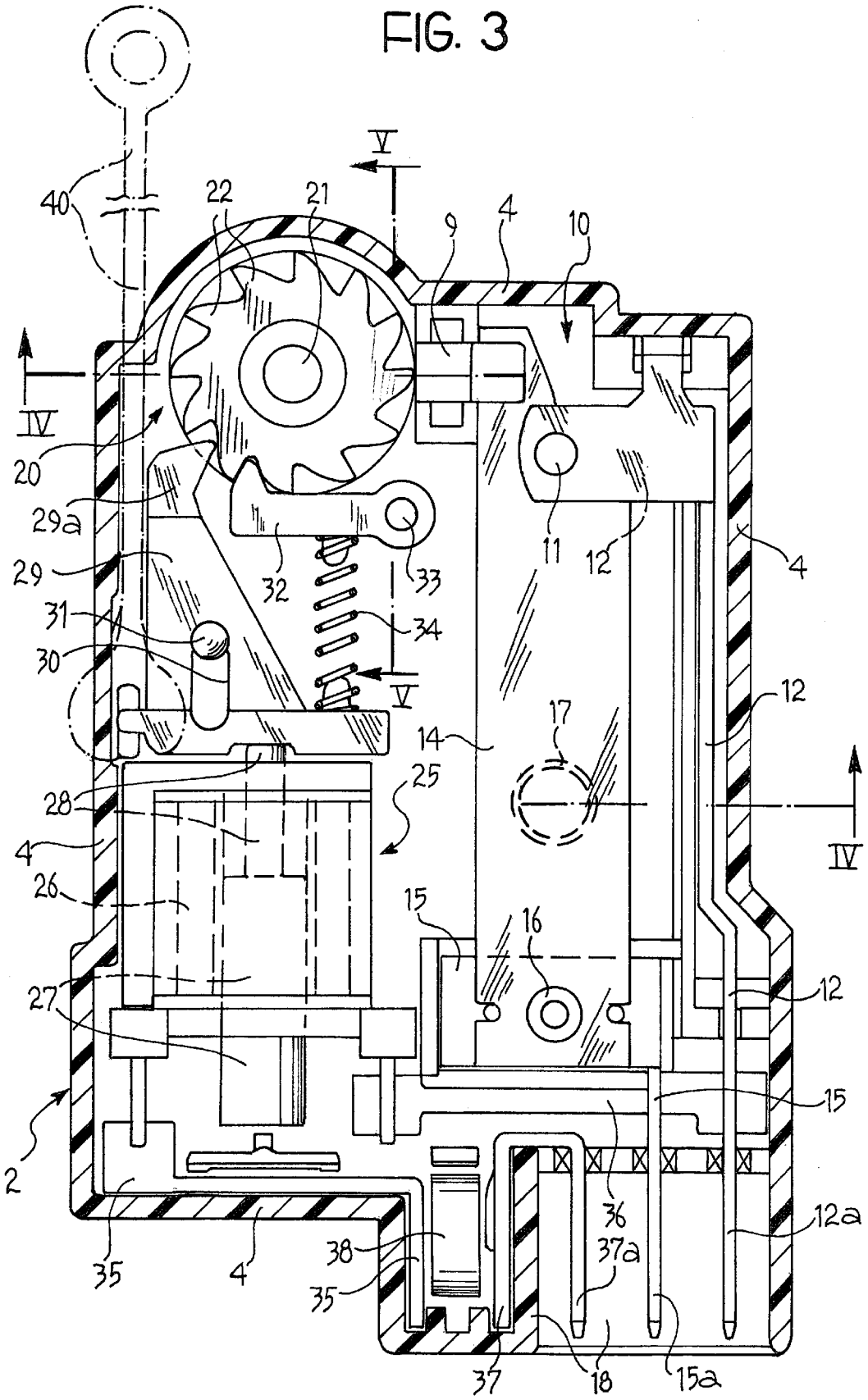
FIG. 3 is a cross-section, on an enlarged scale, along the line III—III of FIG. 2.

With reference to FIG. 3, a switch, shown overall by 10, is disposed within the lower half-shell 4 of the housing 2. This switch comprises a fixed contact 11 borne by a shaped metal member 12, one end 12*a* of which is shaped as a flat pin that extends, as a connection terminal, into a hollow seat 18 of the support housing (FIG. 3).

The switch 10 further comprises a moving contact 13 (FIGS. 4, 6 and 7) borne by one end of a metal plate 14, the other end of which is disposed above a shaped metal member 15 (FIG. 3) and is permanently connected with the latter to the support housing, for instance by means of a rivet 16.

The end of the plate 14 that bears the moving contact 13 extends below the fixed contact 11.

A helical spring 17 (FIGS. 3 and 4) is interposed between the base wall of the support housing 2 and the intermediate portion of the plate 14. This spring tends to urge the plate 14 upwards, and therefore the moving contact 13 towards the fixed contact 11.

The end of the plate 14 that bears the moving contact 13 is engaged in a lateral seat or heel 9*b* of the locking member 9, as can be seen for instance in FIGS. 4 and 6. Consequently, the spring 17 also tends to urge the locking member 9 from the lowered or disengaged position of FIGS. 4 and 6 towards a raised or engaged position shown in FIG. 7, in which this locking member protrudes partially from the opening 8 and is disposed in the path of the retaining member or slide 6, preventing it from returning to the rest position in which it enables the door P to be opened.

The metal connection member 15 forms a projection or end 15*a* (FIG. 3) shaped as a flat pin, which extends into the seat 18 of the support housing and acts as a connection terminal.

Figure 5:
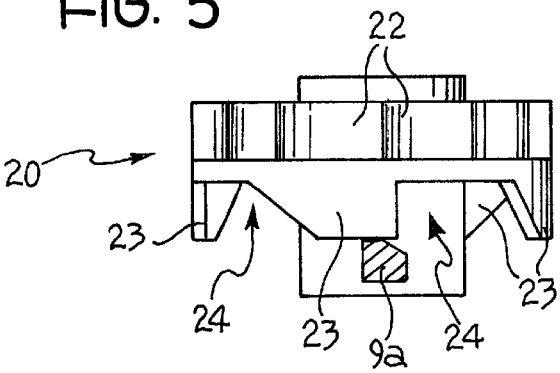
FIG. 5 is a view partly in section along the line V—V of FIG. 3.

As can be seen for instance from FIG. 4, the locking member 9 has a lower radial projection 9*a* on the side opposite the plate 14. This projection cooperates, as will be explained below, with a cam or toothed profile of a toothed wheel 20 mounted to rotate in the support housing about a pin 21, adjacent to the locking member 9. The toothed wheel 20 is conveniently made from plastic material. It may be monolithic or—for simplicity of moulding—may be made in two parts glued or otherwise fixed together. The upper portion of the wheel 20 comprises saw teeth 22, while the lower portion of this wheel comprises a plurality of cams or front teeth 23 equally angularly spaced and separated by intervals 24 (FIG. 5).

In a preferred embodiment, the teeth 23 have a trapezoidal/rectangular shape, with one side or flank inclined and the other side or flank straight.

In the embodiment shown by way of illustration, the wheel 20 has twelve saw teeth 22 and four lower teeth 23. The amplitude of the intervals 24 between consecutive teeth 23 is slightly smaller than the angular field corresponding to two adjacent saw teeth 22. The arrangement is such that when the radial projection 9*a* of the locking member 9 extends below a cam or tooth 23 of the wheel 20, the locking member 9 is held in the lowered or disengaged position, against the action of the spring 17, as shown in FIGS. 4 to 6.

Figure 7:
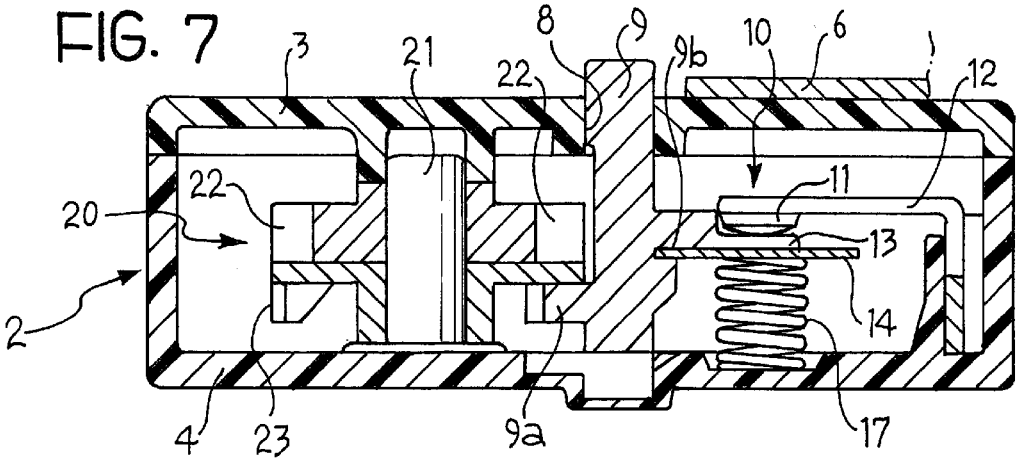
Figure 8:
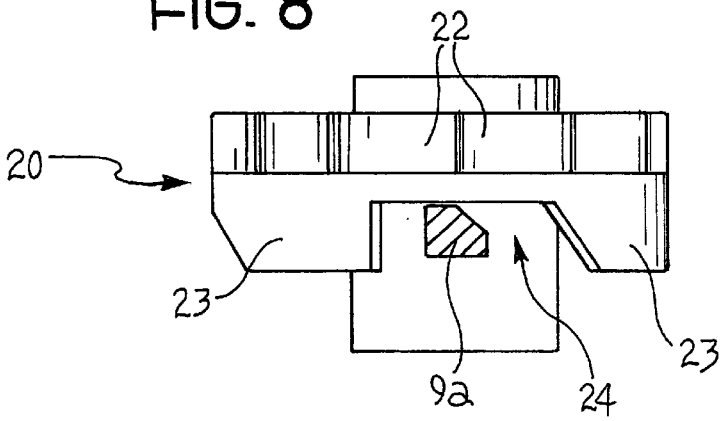
FIG. 8 is a view similar to that of FIG. 5, and shows part of the device in the operating condition to which FIG. 7 refers.

When, however, following an angular displacement, the wheel 20 presents the radial projection 9*a* of the locking member 9 with an interval 24 between two consecutive teeth or cams 23, the locking member 9 is able to move into the forward engaged or locking position under the action of the spring 17, as shown in FIGS. 7 and 8.

An electrically controlled actuator is shown overall by 25 in FIG. 3. In the embodiment shown by way of illustration, this actuator comprises a coil or solenoid 26 within which a core 27, one of whose ends is connected to a rod 28, is mounted such that it can move in axial translation. The end of the rod 28 opposite the core 27 is disposed in a hollow seat of a shaped member shown overall by 29. The median portion of this member has an eyelet opening 30 into which a fixed pin or peg 31, rigid with the support housing of the device, extends.

The end 29*a* of the member 29 opposite the actuator 25 is hook-shaped and engages between a pair of consecutive saw teeth 22 of the wheel 20.

A pawl 32 is mounted to oscillate about a fixed pin 33 and is also engaged between a pair of consecutive saw teeth of the toothed wheel 20, under the action of a helical spring 34 interposed between this pawl and the end of the shaped member 29 adjacent to the actuator 25.

The arrangement described above is such that each time the actuator 25 is excited, the core 27 moves in translation (upwards with respect to FIG. 3) and via the rod 28 causes a displacement of the shaped member 29, which in turn causes the toothed wheel 20 to rotate by one step, i.e. by a distance corresponding to one saw tooth 22. Once this angular displacement has taken place, the pawl 32 again stabilizes the angular position of the toothed wheel 20.

In the embodiment of FIG. 3, the winding or solenoid 26 of the electromagnetic actuator has its terminals connected to a shaped electrically conducting member 35 and respectively to the connection member 12, 12*a* via a conducting bridge 36.

Figure 9:
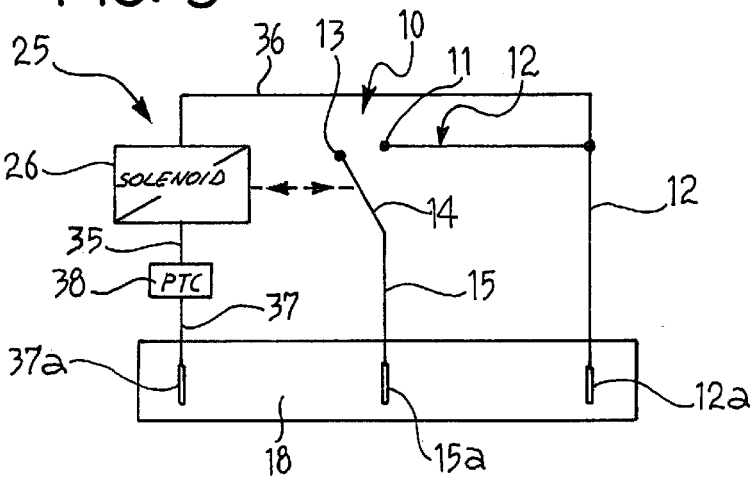
FIG. 9 is an electrical diagram of the device shown in the preceding drawings.

Conveniently, although not necessarily, the shaped connection member 35 may be connected to a conducting member 37, having an end that extends into the hollow seat 18 of the housing of the device and is shaped as a flat pin in order to act as a connection terminal. A positive temperature coefficient (PTC) resistor, shown by 38 in FIGS. 3 and 9, is preferably interposed between the connection members 35 and 37. This resistor advantageously makes it possible automatically to limit the intensity of the current supplied to the coil of the electromagnetic actuator 25 when the duration of supply of this current exceeds a predetermined time. The use of the PTC resistor 38 therefore makes it possible to use an electromagnetic actuator 25 provided with a small-dimension and relatively economic coil 26.

The operation of the locking and unlocking device described above is as follows.

When the door P is opened, the locking and unlocking device 1 is in the condition shown in FIGS. 4 and 5: the locking member 9 is "covered" by the retaining member or slide 6 and is held in the retracted disengaged position under the action of a trapezoidal tooth or cam 23 of the toothed wheel 20 which is disposed on the radial projection 9*a* of this member (FIG. 5).

When the door P is closed, as mentioned above, the slide 6 moves in translation and "uncovers" the locking member 9. At this stage, the locking member 9 is nevertheless held in the retracted disengaged position by the toothed wheel 20 which is still in the same position as in the previous stage.

When the user of the domestic electrical appliance sets this appliance to operate, a control unit of the domestic electrical appliance causes the excitation of the actuator 25 in a manner known per se. As a result of this excitation, the member 29 causes the toothed wheel 20 to rotate by an amount equivalent to the angular extension of a tooth 22 of this wheel. The latter is then disposed in the position shown in FIGS. 7 and 8, in which the lower portion of this wheel presents the radial projection 9*a* of the locking member 9 with an interval 24 between two consecutive trapezoidal teeth or cams 23. Consequently, the locking member 9 is brought into the forward engaged position (FIG. 7) as a result of the thrust exerted by the spring 17 on the plate 14. At the same time, the contact 13 is brought against the fixed contact 11, i.e. the switch 10 is closed. When the locking member 9 is in the forward position, the retaining member or slide 6 is prevented from returning to the rest position in which it enables the door P to be opened.

At the end of the operating cycle of the domestic electrical appliance, in order to enable the door to be opened, the control unit of the appliance causes two successive excitation pulses to be supplied to the coil 26 of the electromagnetic actuator 25. As a result of this, the toothed wheel 20 is caused to rotate by a distance corresponding to the extension of two of its saw teeth. This rotation causes the radial projection 9*a* of the locking member 9 to be engaged by a new trapezoidal tooth or cam 23 of this wheel. The locking member 9 is thus brought back into the retracted or disengaged position shown in FIGS. 5 and 6, in which it again allows the retaining member or slide 6 to return to the position in which the door can be opened.

When the locking member 9 is returned, as described above, into the retracted disengaged position, it simultaneously causes the opening of the switch 10.

As a result of the two excitation pulses needed to enable unlocking, the operation of the device described above is particularly reliable and makes it possible to prevent unlocking from being enabled following an accidental excitation of the actuator 25 due, for instance, to any electromagnetic disturbance that is picked up. The device may, moreover, be configured such that a single excitation pulse needs to be supplied to the electromagnetic actuator 25 for unlocking. In this case, the lower portion of the toothed wheel 20 will obviously have a different number of trapezoidal teeth or cams for the control of the position of the moving member 9.

In any case, in order to enable the door to be unlocked and therefore opened in the event of a discontinuation of the mains current supply, for instance during a power cut, a cable member, such as the member 40 shown in dashed lines in FIG. 3, can be connected to the member 29 such that traction on this cable member causes, via the member 29, the rotation of the toothed wheel 20.

As an alternative, a flexible traction member may be coupled directly to the moving locking member 9 so as to enable this member to be returned to the retracted position in which it enables the door to be opened.

Figure 10:
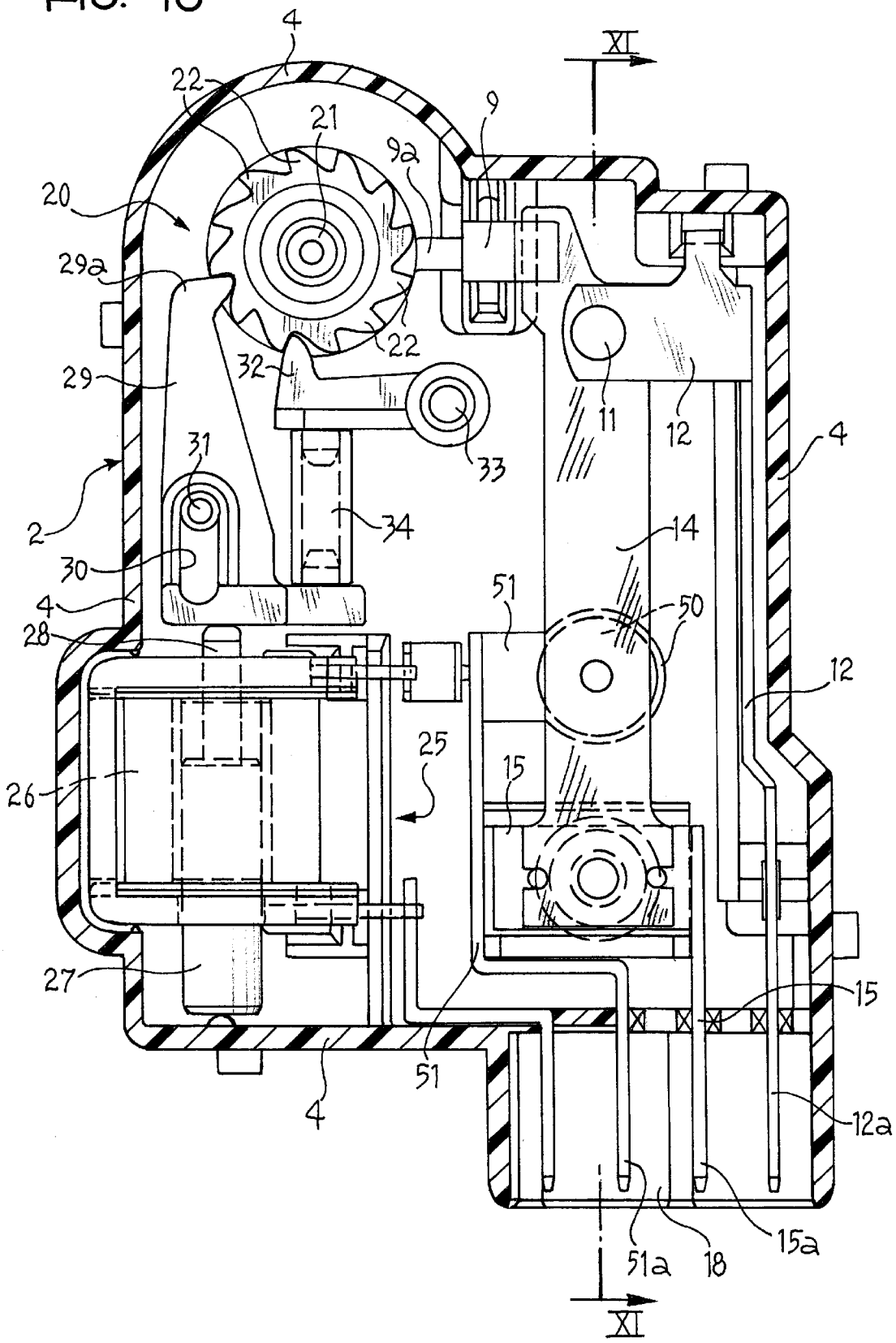
FIG. 10 is a view similar to that of FIG. 3 and shows a variant.
Figure 11:
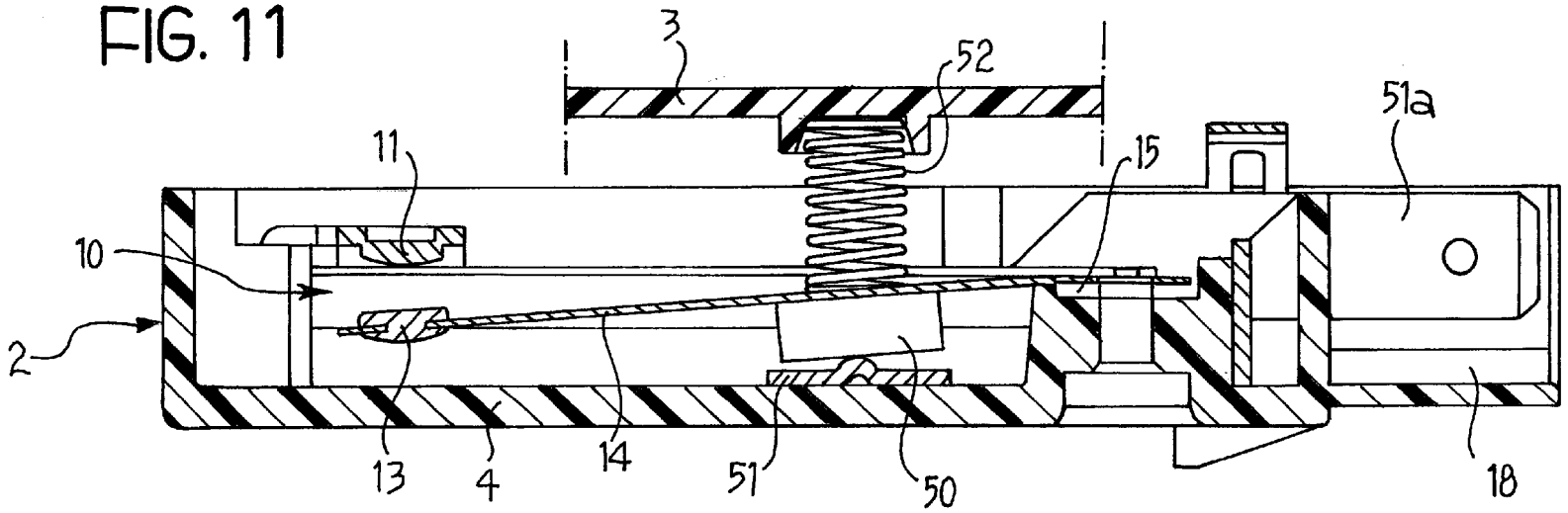
FIG. 11 is a sectional view along the line XI—XI of FIG. 10.
Figure 12:
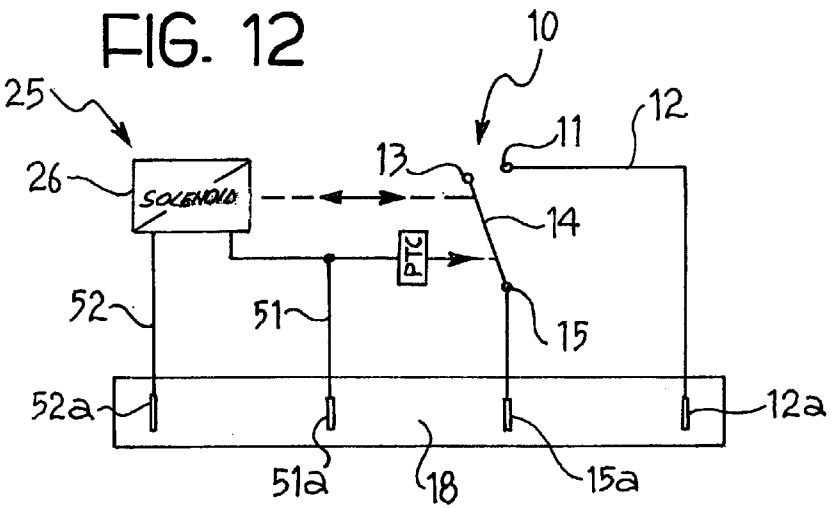
FIG. 12 is an electrical diagram of the device of FIGS. 10 and 11.

FIGS. 10 to 12 show a variant of the device described above. In these drawings, parts and components already described bear the same reference numerals.

In the embodiment of FIGS. 10 to 12, the plate 14 is not a simple metal plate, but a bimetallic plate. Rather than a helical spring, a positive temperature coefficient resistor shown by 50 is disposed below this plate. This resistor 50 bears on a shaped electrically conducting member 51, one end 51*a* of which is shaped as a flat pin and extends into the seat 18 for connection to the control unit of the domestic electrical appliance.

A helical spring 52 (FIG. 11) is disposed between the upper half-shell 3 of the support housing of the device and the bimetallic plate 14, at the location of the PTC resistor 50. This spring ensures that the bimetallic plate 14 remains permanently in contact with the resistor 50.

In the embodiment of FIGS. 10 to 12, the solenoid 26 of the electromagnetic actuator 25 is connected on one side to the shaped conducting member 51 and on the other side to a further connection member 52, ending in a flat pin 52*a* which extends into the seat 18.

The operation of the device of FIGS. 10 to 12 is similar to that of the device described with reference to the preceding drawings, with respect to which it differs in the following respects.

When the domestic electrical appliance is set to operate and the control unit of this appliance supplies an excitation pulse to the actuator 25, the toothed wheel 20 frees the radial projection 9*a* of the locking member 9, as shown in FIG. 8. However, the locking member 9 initially continues to be held in the retracted disengaged position until the PTC resistor 50 reaches a temperature sufficient to cause the switching of the bimetallic plate 14 so as to close the line switch 10 and thus urge the locking member 9 into the forward engaged position.

At the end of the operating cycle of the domestic electrical appliance, following one or more excitation pulses supplied to the actuator 25, the toothed wheel 20 causes the locking member 9 to be lowered and the door P can then be immediately opened, in contrast to conventional PTC and bimetallic plate devices with which the door can be opened only after the PTC resistor has cooled down.

If the current supply is discontinued during an operating cycle of the domestic electrical appliance, the device of FIGS. 10 to 12 enables the door P to be opened without the need for flexible traction members. When the current supply fails and as soon as the PTC resistor 50 has cooled down, the bimetallic plate 14 returns to its rest position, lowering the locking member 9 and opening the line switch 10.

Naturally, the principle of the invention remaining the same, the forms of embodiment and details of construction may be varied widely with respect to those described and illustrated, which have been given purely by way of non-limiting example, without thereby departing from the scope of the invention as set out in the accompanying claims.

What is claimed is:

1. A locking and unlocking device for the door of a domestic electrical appliance, comprising a support housing with an opening for the introduction of a hook member connected to the door, a retaining member mounted to move with respect to the housing between a rest position in which it enables the hook member to be introduced into this opening and an operating position in which it is adapted to retain the hook member introduced into the opening, locking means including a locking member that can move in the housing between a disengaged and an engaged position, in which it is adapted to enable and respectively to prevent the retaining member from moving from the operating position to the rest position, and control means that can be electrically actuated and are adapted to control the position of this locking member, the control means comprising an electrically controlled actuator adapted, whenever it is actuated, to cause a toothed wheel mounted to rotate in the housing and having a predetermined cam or toothed control profile to rotate by a predetermined amount;

the cam or toothed control profile of the toothed wheel being coupled directly to a projection of the locking member such that in at least a first and respectively a second angular position of this wheel the cam or toothed control profile is adapted to retain and respectively release the locking member preventing and respectively enabling it to move from the disengaged to the engaged position;

wherein the toothed wheel has a crown of saw teeth which are equally angularly spaced, cooperating with a hook-shaped end of a control member mounted to move in the support housing under the action of the actuator, the arrangement being such that each excitation of the actuator causes, via the control member, the toothed wheel to rotate by an amount corresponding to a tooth of the saw tooth crown.

2. A device as claimed in claim 1, wherein the control profile of the toothed wheel has a number of cams or teeth such that at least one excitation of the actuator is required to cause the toothed wheel to move from the second to the first position.

3. A device as claimed in claim 2, wherein the control profile of the toothed wheel has a number of cams or teeth such that at least two consecutive excitations of the actuator are required to cause the toothed wheel to move from the second to the first position.

4. A device as claimed in claim 1, wherein the toothed wheel comprises the control profile on the side opposite to the saw tooth crown.

5. A device as claimed in claim 1, wherein the toothed wheel is associated with an oscillating stabilization pawl adapted to be engaged between two consecutive teeth of the crown under the action of associated elastic means tending to urge it towards the toothed wheel.

6. A device as claimed in claim 5, wherein the control member has an end that bears against a moving rod of the actuator and is mounted substantially to move in rotation and translation in the housing, the elastic means being interposed between the pawl and said end of the control member.

7. A device as claimed in claim 6, wherein the control member has a substantially longitudinal guide eyelet in which a pin rigid with the support housing engages.

8. A device as claimed in claim 1, wherein the actuator comprises a solenoid and an associated moving core.

9. A device as claimed in claim 1, wherein the unlocking means comprise a cable or the like connected to the control member associated with the toothed wheel in such a way that traction on this cable or the like is adapted to cause the toothed wheel to rotate.

10. A device as claimed in claim 1, wherein the actuator is connected in series with a positive temperature coefficient resistor member adapted automatically to limit the intensity of the current supplied to this actuator.

11. A locking and unlocking device for the door of a domestic electrical appliance, comprising a support housing with an opening for the introduction of a hook member connected to the door, a retaining member mounted to move with respect to the housing between a rest position in which it enables the hook member to be introduced into this opening and an operating position in which it is adapted to retain the hook member introduced into the opening, locking means including a locking member that can move in the housing between a disengaged and an engaged position, in which it is adapted to enable and respectively to prevent the retaining member from moving from the operating position to the rest position, and control means that can be electrically actuated and are adapted to control the position of this locking member, the control means comprising an electrically controlled actuator adapted, whenever it is actuated, to cause a toothed wheel mounted to rotate in the housing and having a predetermined cam or toothed control profile to rotate by a predetermined amount;

the cam or toothed control profile of the toothed wheel being coupled directly to a projection of the locking member such that in at least a first and respectively a second angular position of this wheel the cam or toothed control profile is adapted to retain and respectively release the locking member preventing and respectively enabling it to move from the disengaged to the engaged position;

an electrical switch including a fixed contact and a moving contact borne by a flexible plate of electrically conducting material mounted in the support housing, said plate being coupled to the locking member in a such a way that the plate causes the closure of the switch when the locking member is in the above-mentioned engaged position in which it prevents the door from being opened.

12. A device as claimed in claim 11, wherein the plate is associated with second elastic means tending to urge it towards the position corresponding to the closure of the switch.

13. A device as claimed in claim 11, comprising unlocking means that can be manually actuated in order to force the locking member to move from the engaged to the disengaged position.

14. A device as claimed in claim 13, wherein the unlocking means comprise a cable or the like connected to the moving locking member in such a way that traction on said cable or the like is adapted to cause the locking member to move into the disengaged position.

15. A device as claimed in claim 13, wherein the unlocking means comprise a cable or the like connected to the control member associated with the toothed wheel in such a way that traction on this cable or the like is adapted to cause the toothed wheel to rotate.

16. A device as claimed in claim 11, wherein the plate is a bimetallic plate associated with heating resistor means adapted to cause a variation of the temperature of this plate in order to cause it to move from an open position to a closed position of the switch.

17. A device as claimed in claim 16, wherein the heating resistor means comprise a positive temperature coefficient resistor disposed between the bimetallic plate and an electrically conducting member, further elastic means being provided to hold said resistor permanently in contact with the bimetallic plate.

* * * * *